United States Patent [19]

Hish

[11] 4,090,391

[45] May 23, 1978

[54] PRESS CONSTRUCTION

[75] Inventor: Joseph R. Hish, Franklin Park, Ill.

[73] Assignee: Industrial Steel Construction, Incorporated, Hodgkins, Ill.

[21] Appl. No.: 770,798

[22] Filed: Feb. 22, 1977

[51] Int. Cl.[2] ..... B21D 43/12; B21J 13/04

[52] U.S. Cl. ..... 72/422; 72/447; 72/455

[58] Field of Search ..... 72/422, 446, 447, 448, 72/455, 419, 426

[56] References Cited

U.S. PATENT DOCUMENTS

| | | | |
|---|---|---|---|
| 1,137,132 | 4/1915 | Gross | 72/447 |
| 2,543,498 | 2/1951 | Japikse | 100/216 |
| 3,126,938 | 3/1964 | McCoy | 72/422 |
| 3,455,141 | 7/1969 | Bracco | 72/446 |

FOREIGN PATENT DOCUMENTS

| | | | |
|---|---|---|---|
| 50,636 | 2/1920 | Sweden | 72/422 |

*Primary Examiner*—C.W. Lanham
*Assistant Examiner*—Gene P. Crosby
*Attorney, Agent, or Firm*—James B. Raden

[57] ABSTRACT

A hydraulic press is disclosed for smoothing sheet metal workpieces. A carrier plate is longitudinally moved through the press frame by a motorized conveyor linkage. The press contains a press ram which only moves laterally and not longitudinally with respect to the workpiece conveyed by the carrier plate. The ram is mounted so that its lateral movement above the workpiece is not restricted and the ram can be moved to a position outward of the lateral edges of a work table on which the workpiece is positioned. Therefore, pressure can be applied to any point on the sheet metal workpiece and the loading and unloading of such workpiece is facilitated. Additionally, the press is provided with a detachable connecting plate which structurally supports the ram mounting assembly but can be easily removed to facilitate ram removal for maintenance or exchange purposes.

6 Claims, 4 Drawing Figures

PRESS CONSTRUCTION

BACKGROUND OF THE INVENTION

This invention relates to an improved construction of hydraulic presses employed for straightening or cambering metallic workpieces such as metal plates, structural shapes and the like. More particularly, it relates to improvements in presses of the type wherein the press ram is mounted within a fixed frame for solely lateral positioning movement relative to a workpiece being fed longitudinally into the press.

It has been found that such presses present certain maintenance and operational problems which have not been remedied heretofore. Specifically, it has been a continuing problem with regard to fixed frame presses to remove the press ram and/or the hydraulic ram operating mechanisms for purposes of maintenance or replacement in prior art presses of this type. The removal and replacement procedures have been cumbersome and time-consuming requiring dismantling of the press frame including for example, the supporting columns, beams and the like. Additionally, after replacement of the components in the assembly, additional time and effort was required to realign and readjust the press.

With regard to the operation of fixed frame presses of the present type, it has been discovered that the installed press ram often interfered with the loading and unloading of excessively long or extremely warped workpieces. This operational problem resulted from the fact that in prior fixed frame type presses, the ram was restrained within the confines of the support columns and its placement therein often interfered with the loading and unloading of such workpieces. Thus, it was a continuing and unresolved problem to facilitate the loading and unloading of such long or badly warped workpieces. Additionally, in operation of presses having restricted ram movement space, when a wide workpiece was encountered, it has been a continuing problem to enable application of ram pressure to the outer lateral edges of the workpiece since the ram did not have sufficient mobility to accommodate such action.

SUMMARY OF THE INVENTION

It is therefore an object of the present invention to provide a fixed frame press which is constructed in a manner such that ram removal for maintenance or exchange purposes is facilitated.

A further object is to provide a hydraulic press construction which enables efficient loading and unloading operations with regard to long or badly warped workpieces.

Another object is to provide a press of the fixed frame type wherein application of ram pressure to any point on the workpieces including the lateral edges thereof is facilitated.

Other objects along with the features and advantages of the invention will become apparent from the following detailed description of the invention when viewed with the drawings.

DETAILED DESCRIPTION

Figure 1:
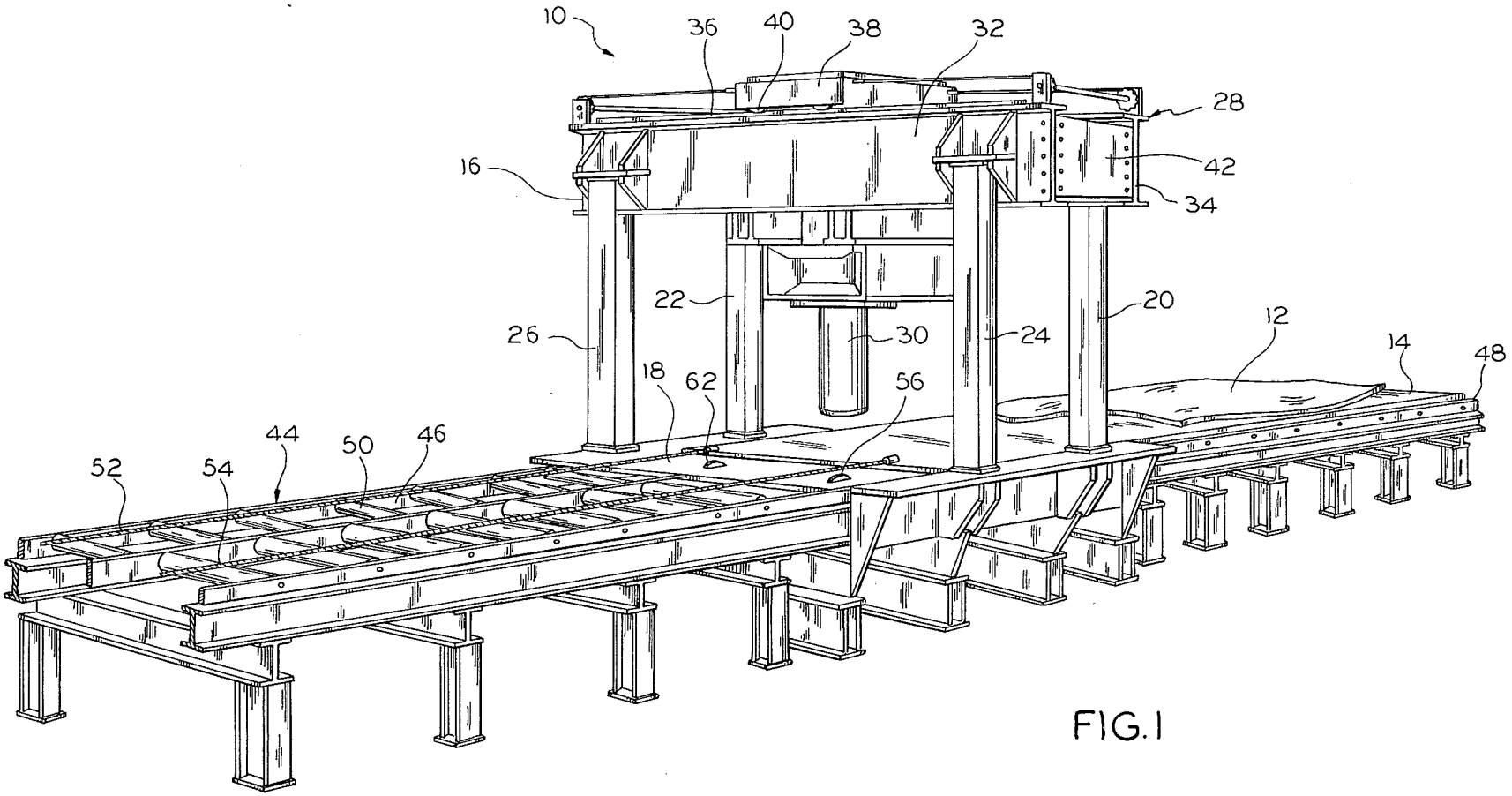
FIG. 1 is a perspective view of a press embodying the invention.

In FIG. 1, a press 10 is shown of the type adapted for straightening or cambering a workpiece 12 such as a steel plate or structural shape. The workpiece 12 is positioned on a carrier plate 14 and the carrier plate 14 is longitudinally moved through a press body 16 by a motorized conveyor linkage which enables intermittent or continuous movement of the plate 14. Thus, the workpiece 12 is transported on the carrier plate 14 into the main press body 16. The press body 16 is constructed as a welded box-frame comprising a work table 18, four support columns 20, 22, 24 and 26, a ram support and carriage assembly 28 and a press ram 30.

The ram 30 is mounted on the assembly 28 in a manner such that it can be moved laterally but not longitudinally with respect to the workpiece 12. The assembly 28 comprises two trolley beams 32 and 34 which are welded to the columns 24, 26 and 20, 22, repsectively, in a manner such that the support columns 20, 22, 24, 26 are outboard of or offset from the beams 32 and 34 rather than being positioned directly thereunder. These beams 32 and 34 support tracks or rails 36. A carriage frame 38, from which the ram 30 is hung, is supported by and rides on the rails 36 by means of bearing wheels 40. A motor 41 is operatively interconnected with the carriage 38 and moves it along the rails 36 to any lateral position above the workpiece 12 which has been conveyed thereunder by longitudinal movement of the carrier plate 14 onto the work table 18. The ram 30 which is hydraulically operated by known means (not shown) is then actuated to move in a vertical direction applying pressure to a desired point on the workpiece 12. In this manner, as each section of the workpiece 12 on carrier plate 14 moves longitudinally onto the work table 18 by virtue of the movement of the carrier plate 14, the ram 30 can be laterally moved thereover and can be actuated to move vertically and impact the workpiece 12 at any point.

Figure 2:
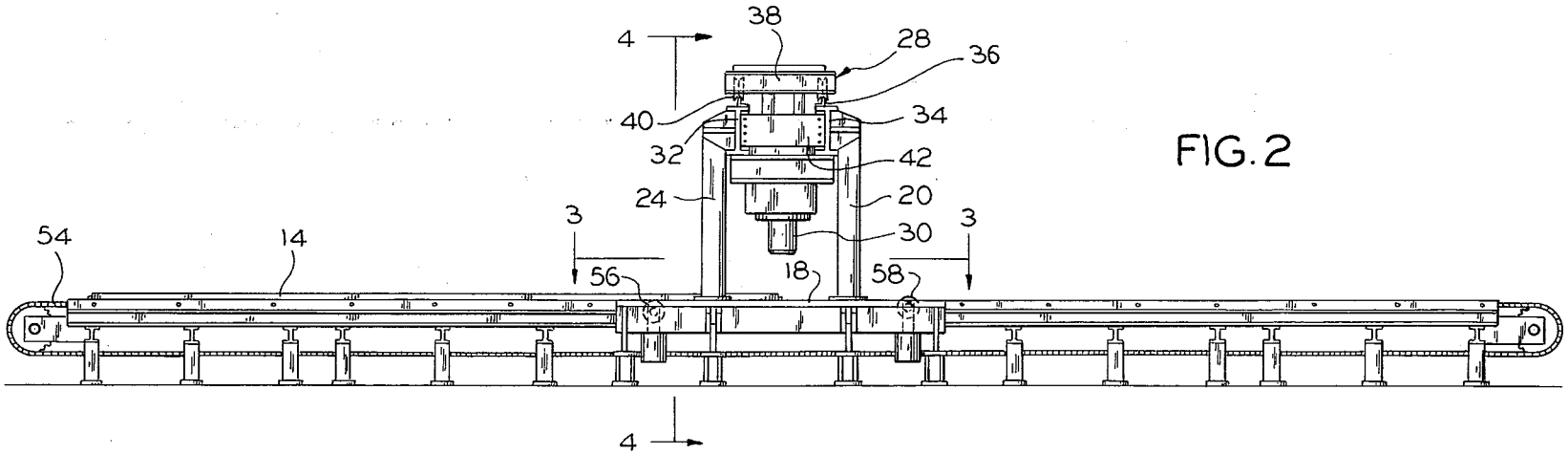
FIG. 2 is a side elevation of the press of FIG. 1.
Figure 4:
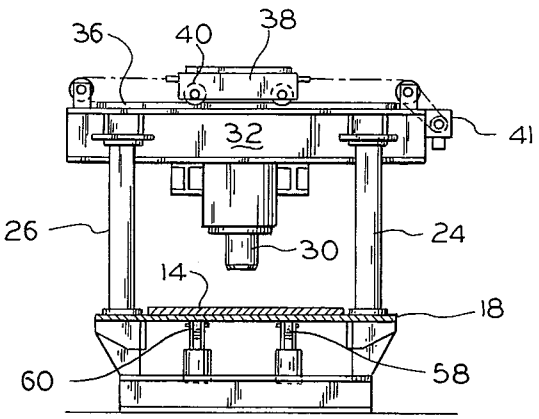
FIG. 4 is a side view taken along lines 4—4 of FIG. 2
Figure 3:
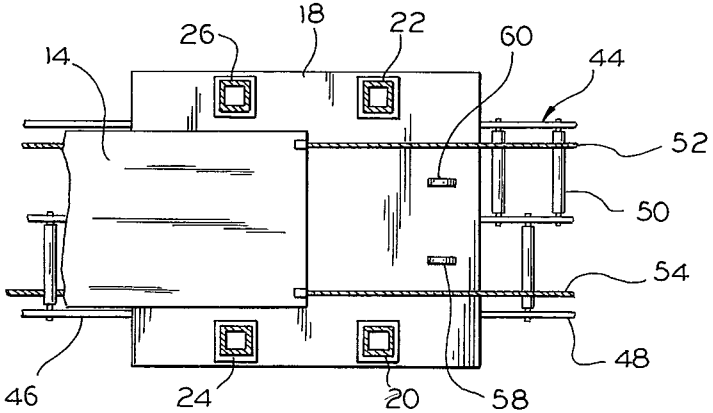
FIG. 3 is a part sectional plan view of the press taken along lines 3—3 of FIG. 2.

As can best be seen in FIG. 2, an upper side plate 42 rigidly connects trolley beams 32 and 34. Plate 42 is bolted to the beams 32 and 34 and is removable therefrom to permit access to and easy removal of ram 30 for purposes of maintenance or ram exchange. In prior presses of this type, it has been standard construction practice to affix the supporting columns 20, 22, 24 and 26 directly under the accompanying beams 32 and 34 and, also, to fixedly attach, as by welding, the side plates 42 between the beams 32 and 34. This prior construction has precluded simple and efficient removal of the ram from the press assemblies. More specifically, when the columns are positioned directly under the trolley beams and the beams are fixedly attached by the connecting plate, it is necessary to disassemble or dismantle the columns, beams and other supporting elements of the press body in order to accomplish removal of the ram therefrom. Accordingly, ram removal or maintenance in these prior art presses has been a time consuming and difficult procedure.

However, as a result of the present construction wherein the columns 20, 22, 24 and 26 are positioned outboard of or offset from the beams 32 and 34 and the connecting plate 42 is removably attached to the beams 32 and 34, ram removal or maintenance procedures can be efficiently and effectively performed in substantially less time and with significantly less effort than in prior presses. Additionally, no realignment or readjustment of the press is required after installation of a replacement ram or after maintenance of the ram with the present press since the columns and beams now remain in a static position during such operations. Such realignment and readjustment was necessitated in prior presses.

The columns 20, 22, 24 and 26 are welded to the work table 18 at their bases and are positioned about the outer lateral edges of the table for offset connection at their upper extremities to the beams 32 and 34 in a manner such that they do not interfere with the movement of the workpiece 12 and carrier plate 14 onto the work table 18. In regard to the positioning of the columns 20, 22, 24 and 26, as previously noted, this positioning is of significance in regard to the efficient removal of the ram 30 from the body 16 in the present construction. Furthermore, it has been noted in prior presses of this type that the placement of the columns restricted the movement of the ram so that the ram often interfered with the loading and unloading of long or extremely warped workpieces. In the present construction, this problem has been essentially eliminated by the positioning of the columns 20, 22, 24 and 26 about the work table 18 and by the attachment of the columns 20, 22, 24 and 26 outboard of or offset from the trolley beams 32 and 34 rather than positioning the columns directly under these beams for support thereof as had been standard heretofore. In view of the present construction, means are now provided for enabling the ram 30 to pass between the columns 20, 24 and 22, 26 and to move entirely outside of the lateral edges of the work table 18. This freedom of movement of the ram 30 achieves increased open headroom above the workpiece 12 facilitating the loading and unloading of long or badly warped workpieces 12.

In operation, a workpiece 12 is placed on the carrier plate 14 which is initially positioned at either side of the press body 16. The carrier 14 bearing the workpiece 12 is then moved longitudinally along a conveyor assembly 44 which comprises conveyor surfaces 46 and 48 extending from opposite sides of the press body 16 and including a plurality of staggered rollers 50 supporting the plate 14 and facilitating movement of the plate 14 in a longitudinal direction. Movement of the plate 14 is effected by means of motorized chain belts 52 and 54 attached thereto that pull the plate 14 over the rollers 50. The chain belts 52 and 54 are affixed to the plate 14 at the longitudinal ends thereof at equidistant points inboard of the lateral edges of the plate 14. This positioning of the belts 52 and 54 results in a smooth, uniform movement of the carrier plate 14 and workpiece 12. In prior presses of this type, the chain belts have been attached at each outermost corner of the plate which tended to cause the plate to rack or move unevenly down the length of the conveyor assembly.

As the workpiece 12 enters the press body 16 by movement of the plate 14, four camroller type hydraulically retractable auxiliary rollers 56, 58, 60 and 62 extending from the surface of the work table 18 engage the plate 14 and automatically raise the plate 14 with the workpiece 12 thereon slightly above the table surface while the carrier 14 is in motion. When the carrier 14, which can be moved continuously or at any desired incremental distance by means of the motorized action of chains 52 and 54, is stopped the rollers 56, 58, 60 and 62 automatically retract into the table surface and the plate 14 and workpiece 12 rest firmly on the table 18. The ram 30 is then moved laterally into position above the workpiece 12 resting on the plate 14 and table 18, and the ram 30 is hydraulically actuated in a vertical direction to impact the workpiece 12 so as to straighten or camber it. In this manner, with the longitudinal movement of the workpiece 12 through the press body 16 and the full lateral movement of the ram 30 enabled by the present construction of the press 10, ram pressure can be applied at any point on the workpiece 12 including the lateral edges thereof.

After completion of a pressing operation, the ram 30 is retracted vertically and the carrier 14 with the workpiece 12 is moved longitudinally in either direction so that the next point on the workpiece 12 can be pressed. Upon initiating movement of the carrier 14, the rollers 56, 58, 60 and 62 automatically raise and enable the carrier 14 to move smoothly onto the appropriate conveyor surface 46 or 48. In this manner, the workpiece 12 can be passed through the press body 16 as many times as is necessary to achieve the desired results. Upon completion of the pressing of a workpiece 12, the chain belts 52 and 54 which are motorized to move the carrier plate 14 in either direction will move the carrier 14 and workpiece 12 to any desired point on the conveyor 44 at either side of the press body 16 to enable unloading to the finished workpiece simply and efficiently.

What has been taught, then, is an improved press construction facilitating maintenance of the operational parts thereof, enabling better and more efficient loading and unloading of workpieces and improving the working capabilities of the press. The forms of the invention illustrated and described herein are but preferred embodiments of these teachings. They are shown as an illustration of the inventive concepts, however, rather than by way of limitations, and it is pointed out that various modifications and alterations may be indulged within the scope of the appended claims.

We claim:

1. In a press for straightening or cambering metallic workpieces including a fixed press frame, a carrier means for longitudinally conveying said workpiece onto a work table positioned in said frame, a ram in said frame operable in a vertical direction for impacting said workpiece, the combination comprising means for effecting lateral movement of said ram above said work table to a position outward of the lateral edges of said work table to facilitate loading and unloading of said workpiece on said work table and to allow said ram to impact said workpiece at any lateral point including the lateral edges thereof, said ram moving means including a carriage from which said ram is suspended and rails on which said carriage moves, said press frame including support means for said rail, a plate connected to said support means for rigidly interconnecting said rail support means, said plate being detachable from said rail support means to facilitate access to and maintenace of said ram.

2. The press of claim 1 including hydraulically retractable means extending from the surface of said work table for facilitating longitudinal movement and conveyance of said workpiece onto said work table.

3. The press of claim 1 wherein said carrier means comprises a carrier plate for supporting said workpiece, a conveyor means and a linkage operatively affixed to said carrier plate for moving said plate supporting said workpiece along said conveyor.

4. The press of claim 3 wherein said conveyor means extends longitudinally outward from opposite sides of said press frame and said carrier plate is movable along said conveyor in either longitudinal direction.

5. The press of claim 3 including retractable means extending from the surface of said work table for facilitating movement and conveyance of said carrier plate supporting said workpiece onto said work table.

6. The press of claim 3 wherein said linkage comprises two chain belts each attached to said carrier plate at its opposing longitudinal ends and at equidistant points inboard of the lateral edges of the plate.

* * * * *